United States Patent [19]

White, Jr. et al.

[11] Patent Number: 4,536,280

[45] Date of Patent: Aug. 20, 1985

[54] VISBREAKING PROCESS

[75] Inventors: John B. White, Jr., Mt. Prospect; Robert E. McHarg, Arlington Hts.; Frank Stolfa, Park Ridge, all of Ill.

[73] Assignee: UOP Inc., Des Plaines, Ill.

[21] Appl. No.: 563,327

[22] Filed: Dec. 19, 1983

[51] Int. Cl.[3] ..... C10G 9/00

[52] U.S. Cl. ..... 208/106; 208/107

[58] Field of Search ..... 208/106, 107

[56] References Cited

U.S. PATENT DOCUMENTS

| | | | |
|---|---|---|---|
| 3,065,165 | 11/1962 | Amis et al. | 208/106 |
| 4,029,571 | 6/1977 | Curtin | 208/106 |
| 4,169,782 | 10/1979 | Thompson | 208/102 |

OTHER PUBLICATIONS

Olsen, "Unit Processes and Principles of Chemical Engineering", D. Van Nostrand Co., Inc., pp. 1-3, 1932.

"Combination Unit", Petroleum Refiner, Sep. 1958, p. 249.

Hydrocarbon Processing, May 1980, pp. 101-109, "New Roles for Thermal Cracking", by Frank Stolfa.

Oil & Gas Journal, Apr. 13, 1981, pp. 109-120, "Visbreaking Process has Strong Revival", by Martin Hus.

Hydrocarbon Processing, Jan. 1979, pp. 131-136, "Visbreaking: A Flexible Process", by A. Rhoe et al.

Kirk-Othmer Encyclopedia of Chemical Technology, 2nd Ed., vol. 15, pp. 18-23, 1968 by John Wiley & Sons, Inc.

*Primary Examiner*—D. E. Gantz

*Assistant Examiner*—Chung K. Pak

*Attorney, Agent, or Firm*—Thomas K. McBride; William H. Page, II; John F. Spears, Jr.

[57] ABSTRACT

An improved visbreaking process having a lower utilities (heating fuel) cost is disclosed. The feed stream is heated by indirect heat exchange against the bottoms stream of a first fractionation column, which receives the effluent of the visbreaking heater. A portion of this bottoms stream is then used as quench. This quench stream is hotter and has a higher flow rate than previous designs. The feed is heated to a higher temperture by the indirect heat exchange and therefore less fuel is required in the visbreaker fired heater.

6 Claims, 1 Drawing Figure

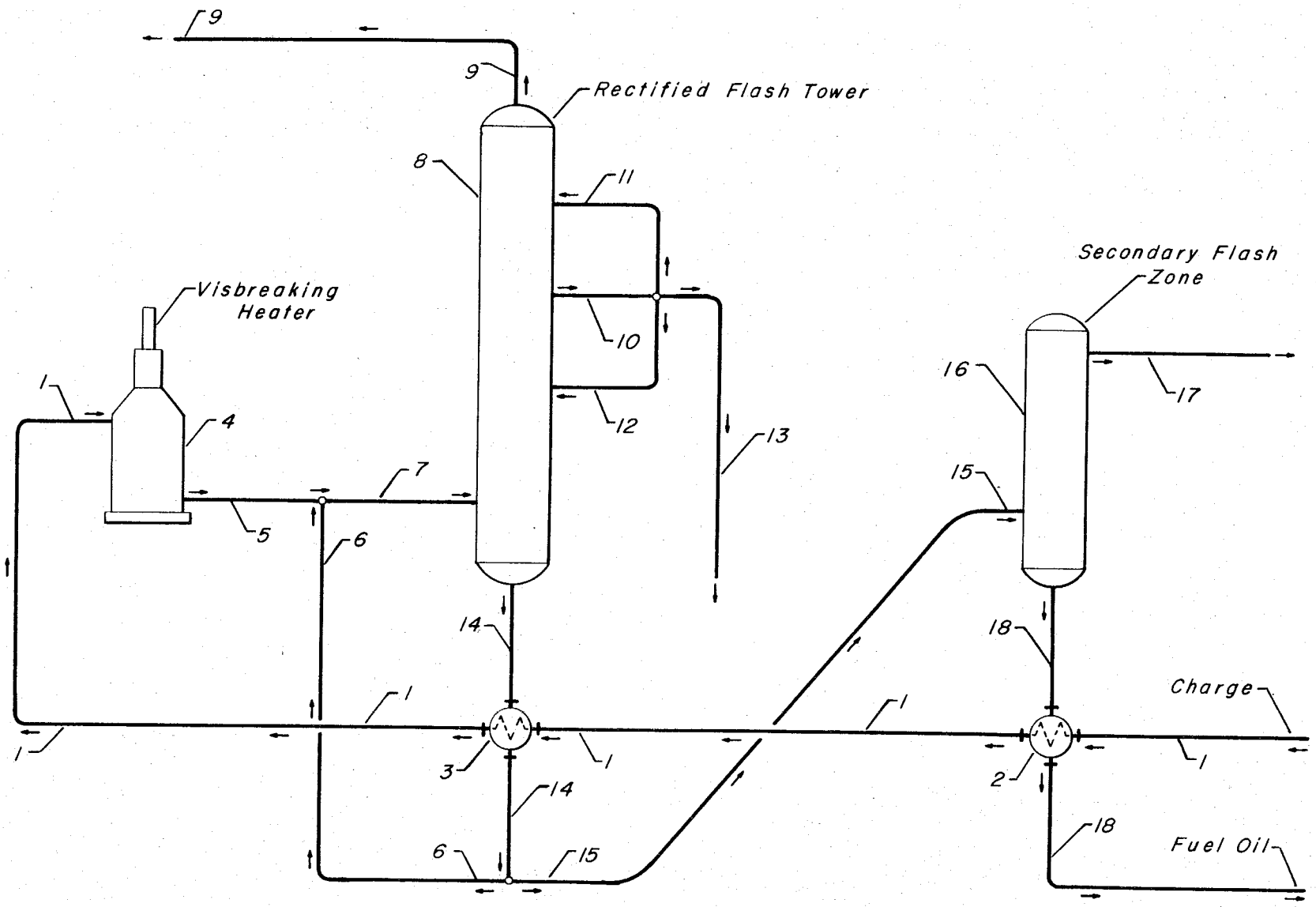
Secondary Flash Zone
Charge
Fuel Oil
Rectified Flash Tower
Visbreaking Heater
1
2
3
4
5
6
7
8
9
10
11
12
13
14
15
16
17
18

VISBREAKING PROCESS

FIELD OF THE INVENTION

The invention relates to a hydrocarbon conversion process which may be employed in the refining of crude oils. The invention is an improved visbreaking process and therefore relates to the thermal processing of residual hydrocarbon streams normally produced by the fractional distillation of crude oil. The invention specifically relates to the heat exchange which may be employed in such a process in order to minimize the fuel consumption within the process and to maximize heat recovery. The invention also specifically concerns the manner in which the effluent of the visbreaking heater or visbreaking reaction chamber is quenched with a lower temperature hydrocarbon stream to terminate the thermal cracking reaction.

INFORMATION DISCLOSURE

Visbreaking is a very well established commercial refining process. An extensive discussion of visbreaking and related thermal cracking processes is provided in the article appearing at page 101 of the May 1980 issue of *Hydrocarbon Processing.* U.S. Pat. No. 4,169,782 issued to H. L. Thompson presents a rather complete process flow diagram of a commercial visbreaking process. This reference is also pertinent for its description of the materials which may be employed as the quench liquid which is admixed with the effluent of the visbreaking heater.

An article appearing at page 109 of the Apr. 13, 1981 edition of the *Oil and Gas Journal* provides additional description of the visbreaking process. This article is especially pertinent for its showing of the use of a portion of the bottoms stream of a fractionator which receives the visbreaker effluent as the quench stream which is admixed into the visbreaker effluent. An article appearing at page 131 of the January 1979 issue of *Hydrocarbon Processing* is also directed to visbreaking. This article is pertinent for the teaching which begins on page 135 in regard to the usefulness of quenching the visbreaking heater effluent stream and the various materials which can be employed as the quench stream.

The process flow diagram of a visbreaking unit shown in FIG. 9 on page 22 of Volume 15 of the Second Edition of the *Kirk-Othmer Encyclopedia of Chemical Technology* shows various indirect heat exchangers employed in the process. The diagram is pertinent for indicating an awareness in the art of the desirability of heating the charge stream by indirect heat exchange.

BRIEF SUMMARY OF THE INVENTION

The invention provides an improved visbreaking process by reducing both the capital and utilities cost of the process. These improvements are achieved by heating the feed stream to the visbreaking heater by indirect heat exchange in a manner which heats the stream to a higher temperature than in prior art processes. Since the feed stream is at a higher temperature when it enters the visbreaking heater, less fuel must be consumed within the heater and the heater may be of smaller size.

A significant part of the subject process is the utilization of a quench stream having a higher temperature and higher flow rate than conventional visbreaking processes. The use of a larger quench stream provides an adequate temperature reduction of the visbreaker heater effluent even though the quench material is at a relatively high temperature.

The invention may be broadly characterized as a method of thermally processing a hydrocarbon stream which comprises the steps of heating a feed stream, which comprises a mixture of hydrocarbons having boiling points above 600° F., by indirect heat exchange against a hereinafter characterized first bottoms stream; passing the feed stream through a visbreaking zone, and admixing a resultant visbreaking zone effluent stream with a relatively high temperature quench stream to thereby form a first process stream; separating the first process stream in a first separation zone into the desired hydrocarbon fractions including the previously referred to first bottoms stream; employing the first bottoms stream in said indirect heat exchange and then dividing the first bottoms stream into at least said quench stream and a second process stream; and passing the second process stream into a second separation zone, and recovering a product stream from the second separation zone.

BRIEF DESCRIPTION OF THE DRAWING

The drawing is a simplified process flow diagram of a preferred embodiment of the invention. The drawing has been simplified by the elimination of various process equipment customarily employed on such a process including flow control systems, temperature and pressure control systems, pumps, vessel internals, etc. This presentation of one preferred embodiment of the process is not intended to preclude from the scope of the subject invention those other embodiments set out herein.

A charge stream comprising a reduced crude oil as a vacuum bottoms fraction enters the process through line 1 and is first heated by indirect heat exchange in the exchanger 2. The charge stream is then further heated in the indirect heat exchange means 3 and is passed into the visbreaking heater 4. After being subjected to the visbreaking conditions maintained in the heater and in an optional additional reaction chamber not shown, the visbreaking zone effluent stream carried by line 5 is admixed with a quench stream carried by line 6. The quench stream reduces the temperature of the visbreaking zone effluent stream below visbreaking temperatures. The admixture of these two streams is passed through line 7 into a rectified flash tower or fractionator 8.

The hydrocarbons which enter the rectified flash tower are separated into a number of hydrocarbon fractions each having a different boiling point range. Therefore, an overhead vapor stream is removed through line 9. This vapor stream is passed to the appropriate facilities for the recovery and separation of the naphtha boiling range hydrocarbons contained within this vapor stream. A sidecut stream is normally removed from an intermediate point in the tower as through line 10. This is normally a gas oil boiling range mixture of hydrocarbons. This stream is normally cooled by indirect heat exchange not shown and divided into a number of smaller streams. Streams of the cooled gas oil are therefore passed into the tower through lines 11 and 12 to aid in the separation while a third stream may be removed from the process through line 13 as a product stream.

The remainder of the hydrocarbons which enter the flash tower are concentrated into a bottoms stream removed through line 14. The undivided bottoms stream is cooled by indirect heat exchange against the charge stream. The flash tower bottoms stream is then divided into the quench stream passed through line 6 and a second stream passed into a secondary flash zone through line 15. The secondary flash zone 16 is operated at a lower pressure than the flash tower 8. The hydrocarbons entering the secondary flash zone are therein separated into one or more lighter fractions such as a light and heavy gas oil. This is represented by the removal of a gas oil stream through line 17. The remainder of the entering hydrocarbons are concentrated into a second bottoms stream removed through line 18. Heat is recovered from this stream by indirect heat exchange against the charge stream and the second bottoms stream is then removed as a fuel oil after being blended with a suitable amount of a cutter or cutback oil from a means not shown.

DETAILED DESCRIPTION

Visbreaking is a mild thermal cracking type of hydrocarbon conversion process which is normally employed to reduce the viscosity and/or pour point of various heavy petroleum-derived hydrocarbonaceous liquids. The visbreaking operation may be employed to decrease the amount of low value residual material produced in a petroleum refinery by upgrading a portion of the charge stock to a salable fuel oil product. It is also normal to recover some lighter hydrocarbons such as naphtha which are produced by the thermal cracking operation. The visbreaking process may employ a single fractionation column as the initial separation zone or may be integrated with a vacuum fractionation column to recover additional amounts of light and heavy gas oils.

The visbreaking operation comprises the basic steps of heating the charge material to the relatively high temperature required for the mild thermal cracking operation and maintaining the charge stock at this temperature for a predetermined time, which is inversely proportional to the temperature employed. The material treated in this manner is then quenched to a temperature low enough to terminate the thermal cracking reactions and passed into the separation facilities.

As with all such processes in which a charge stream must be heated to an elevated temperature, the inherent inefficiency of heat recovery requires a net input of heat. In a thermal cracking process such as visbreaking, a large portion of this heat is consumed within the fired charge stock heater. The consumption of this fuel therefore represents a sizable part of the utilities cost of operating the process. It is an objective of the subject invention to provide an improved visbreaking process. It is a specific objective of the subject invention to provide a visbreaking process having a lower utilities cost of operation due to a decrease in the fuel consumed in the visbreaking heater.

The feed stream to a visbreaking process is normally a heavy hydrocarbon stream such as a topped crude oil or a vacuum reduced crude oil. These materials are normally referred to as residual oils. Visbreaking may also be applied to heavy crude oils and other hydrocarbonaceous materials. However, this variety of materials shares the common characteristic of containing heavy hydrocarbons normally having boiling points, as determined by the appropriate ASTM distillation, above about 600° F. (315° C.). It is preferred that the charge stock to the visbreaking operation has a 10% boiling point above 500° F. (260° C.).

The charge stock to the visbreaking operation is first heated by indirect heat exchange in various heat recovery steps. It is then passed into a visbreaking zone which comprises the visbreaking heater and if employed in the process a reaction chamber or soak zone which basically increases the residence time of the heated charge material at the desired temperature. Steam may be admixed with the feed stream to minimize coking within the heater tubes of the visbreaking furnace. The visbreaking heater and any reaction chamber are maintained at visbreaking conditions. Visbreaking conditions in general include a temperature within the general range of about 800° to about 975° F. (426°–523° C.), with temperatures above 900° F. (482° C.) being preferred. Normal visbreaking conditions also comprise a pressure between about 25 and 400 psig although higher pressures to about 1000 psig have been described in the literature. The charge stock is preferably subjected to these visbreaking conditions for a period of about 20 to 65 equivalent seconds at a temperature above 900° F. while within the visbreaking zone. The effluent of the visbreaker heater is then preferably quenched, as with a gas oil, to reduce its temperature by about 70° to 140° F. A common variation in visbreaking is the use of a soaker drum in which the still-hot effluent of the visbreaker heater is retained for a preselected time prior to quenching. In these soaker-type visbreakers, the thermal conversion reactions continue within the drum thereby allowing a reduction in the temperature required for the same degree of conversion. The exact conditions of temperature and pressure which are preferred will vary with such factors as the characteristics of the feed material and the degree of thermal cracking desired. Further information on visbreaking may be obtained from many sources including the previously cited references.

In the subject process, the feed stream is heated to the desired visbreaking temperature by a combination of indirect heat exchange against high temperature process streams and the use of a fired heater. The initial heating includes the exchange of the feed stream against the total bottoms stream of the first separation zone. The initial heating preferably also includes an indirect heat exchange against the bottoms stream of the second separation zone. However, the subject invention centers on the heat exchange with the bottoms stream of the first separation zone. This heat exchange heats the feed stream to a higher temperature than prior art methods therefore reducing the amount of heating required in the fired heater.

The ability of this heat exchange to produce a higher feed stream preheat temperature is due to the use of a "relatively high temperature" quench stream of residual (bottoms) material and to the use of a higher temperature unflashed bottoms stream. As used herein, the term "relatively high temperature quench" is intended to refer to a quench stream having a temperature less than about 300 Fahrenheit degrees cooler than the visbreaker effluent stream. The use of a hot quench stream requires the use of a larger amount of quench. The flow rate of the quench stream preferably exceeds that of the unquenched visbreaker heater effluent. Since the hot quench material is bottoms liquid from the separation zone, it will again be concentrated into the bottoms stream when it returns to the separation zone. Hence, the flow rate of the bottoms stream increases. More heat can therefore be removed from the bottoms stream and used to heat the feed stream without cooling the bottoms more than is desired. The feed stream may thereby be heated to a higher temperature even if the temperature of the bottoms stream is the same as in the prior art before and after the exchange. This method of increasing the flow rate of the heat exchange media is of course limited by the associated increases in pumping and piping costs and therefore must be optimized.

A preferred embodiment of the invention may be described as a visbreaking process which comprises heating a residual oil feed stream by indirect heat exchange against a hereinafter characterized first bottoms stream; passing the feed stream through a visbreaking zone, and then admixing the resultant visbreaker zone effluent stream with a relatively high temperature quench stream having a temperature above about 600° F. and thereby forming a first process stream; passing the first process stream into a first separation zone in which entering hydrocarbons are separated into different boiling point range fractions including the previously referred to first bottoms stream; cooling the first bottoms stream in the previously described heat exchange and then dividing the first bottoms stream into the previously referred to quench stream and a second process stream; and passing the second process stream into a lower pressure second separation zone and recovering a product stream from the second separation zone.

In the subject process, the quenched effluent of the visbreaking zone is passed into the first of two separation zones. These zones may each have a number of configurations, with the design of the separation zones varying with charge stock properties, desired products and process conditions, etc. Preferably, the first separation zone comprises a rectified flash tower. The quenched effluent is directed into the bottom, void section of the rectified flash tower at a point some distance above the bottom of the column. This column is operated at a pressure of about 45 to 150 psig and at a bottom temperature of within the range of about 365° to 460° C. Preferably, the pressure is above 60 psig. As used herein, specified pressures refer to the pressure found at the top of the separation vessel and temperatures refer to the bottom temperature of the vessel under consideration. A liquid phase is collected in the bottom of the column below the feed point and removed as a bottoms stream. The rectified flash tower is to have means to supply adequate cooling to the top section of the column to condense sizable amounts of liquid and effect countercurrent vapor-liquid flow. The upper rectification section is preferably separated from the lower section by a trap-out tray. The upper section preferably contains at least five fractionation trays and is fed reflux liquid at the top tray. A liquid stream removed at the trap-out tray may be cooled and returned to the upper section at a higher point which is intermediate two fractionation trays to aid the separatory operation.

The bottoms stream removed from the first separation zone is subjected to an indirect heat exchange step in which it is cooled. Preferably, this cooling is effected solely by heat exchange against the visbreaker feed stream. It is also preferred that the heat exchange is performed before the bottoms stream is flashed to a lower pressure, such as the pressure of the second separation zone. After being cooled, the bottoms stream is divided into aliquot portions passed into the second separation zone and used as quench. The temperature of the bottoms stream after the heat exchange, and therefore the temperature of the relatively high temperature quench stream, should be above about 600° F. (315° C.) and is preferably above 650° F. (343° C.). More preferably, the quench stream has a temperature above approximately 680° F. (360° C.). The flow rate of the quench stream is set by the flow rate and temperature of the visbreaker effluent stream, the temperature of the quench stream, and the desired temperature decrease to be provided by the quench and may therefore be calculated.

The remainder of the bottoms stream of the first separation zone is passed into a second separation zone often referred to as a secondary flash zone. This is preferably a void vessel having an upper vapor outlet and adapted to retain a liquid level below the feed point. A liquid is preferably sprayed into the vessel at a central location above the feed point. The secondary flash zone is operated at a lower pressure than the first separation zone. A broad range of temperatures for use in this zone is from about 340° to about 400° C. The pressure in this zone should be at least 30 psig below that at which the bottom section of the rectified flash zone is operated. A range of pressures for this zone includes pressures from about 0 to 100 psig. The design and operation of the first and second separation zones and the other apparatus employed in the subject invention are not of themselves unique.

It is believed well within the expertise of those skilled in the refining arts to design suitable process equipment. Nevertheless, to ensure a proper understanding of the process, the following example based on engineering design (calculated) operation of a commercial scale unit are provided. The feed stream is a 20,000 barrels per day stream of a reduced crude oil. In this example, the temperatures enclosed in parentheses are the equivalent temperatures which would be expected in a prior art (low temperature) quench system. The feed stream enters the process at approximately 480° F. and is heated to about 550° F. by indirect heat exchange against the bottoms stream of the second separation zone, which is cooled from 650° F. to about 550° F. The thus-heated feed is then further heated to 710° F. (670° F.) by indirect heat exchange against the bottoms stream of the first separation zone. The feed is then passed into the visbreaker heater and heated to approximately 925° F. The effluent of the visbreaker heater is quenched to approximately 820° F. with the high temperature quench of the subject invention. This quench has a temperature of about 700° F. (550° F.). To compensate for the higher temperature of the quench liquid, the amount of quench is increased from a representative prior art weight ratio of quench to effluent of 0.65:1 to a ratio of 1.45:1. The flow rate of the bottoms stream is therefore significantly increased. In this example, the increased temperature of the feed to the visbreaker heater (40 Fahrenheit degrees) reduces the cost of the visbreaker heater and produces a fuel savings of at least 10%. Although in this example some of the increased heating of the feed stream results from the use of an unflashed and therefore hotter bottoms liquid from the first separation zone, a significant portion of the improved heating results from the increased temperature of the quench stream and the corresponding higher mass flow rate of the total bottoms stream.

We claim as our invention:

1. A method of thermally processing a hydrocarbon stream which comprises the steps of:

(a) heating a feed stream, which comprises a mixture of hydrocarbons having boiling points above 600°

F., by indirect heat exchange against a hereinafter characterized first bottoms stream;

(b) passing the feed stream through a visbreaking zone, and admixing a resultant visbreaking zone effluent stream with a relatively high temperature quench stream having a temperature of above 600° F. to form a first process stream wherein the flow rate of the quench stream is greater than the flow rate of the visbreaking effluent stream;

(c) separating the first processor stream in a first separation zone into the desired hydrocarbon fractions including the previously referred to first bottoms stream;

(d) employing the first bottoms stream in said indirect heat exchange and then dividing the first bottoms stream into at least said quench stream and a second process stream; and, (e) passing the second process stream into a second separation zone, and recovering a product stream from the second separation zone.

2. The method of claim 1 further characterized in that the feed stream is heated by indirect heat exchange against a second bottoms stream, which is removed from the second separation zone, prior to being heated by heat exchange against the first bottoms stream.

3. The method of claim 1 further characterized in that the feed stream is a residual oil having an initial boiling point above about 600° F.

4. A visbreaking process which comprises the steps of:

(a) heating a residual oil feed stream by indirect heat exchange against a hereinafter characterized first bottoms stream;

(b) passing the feed stream through a visbreaking zone, and then admixing a resultant visbreaker zone effluent stream with a relatively high temperature quench stream having a temperature of above 600° F. to form a first process stream wherein the quench stream has a greater flow rate than the flow rate of said visbreaker effluent stream;

(c) passing the first process stream into a first separation zone in which entering hydrocarbons are separated into different boiling point range fractions including the previously referred to first bottoms stream;

(d) cooling the first bottoms stream in the previously described heat exchange and then dividing the first bottoms stream into the previously referred to quench stream and a second process stream; and, (e) passing the second process stream into a second separation zone and recovering a product stream from the second separation zone.

5. The process of claim 4 further characterized in that the quench stream has a temperature greater than 650° F.

6. The process of claim 5 further characterized in that a second bottoms stream is removed from the second separation zone and the feed stream is heated by indirect heat exchange against the second bottoms stream.

* * * * *